United States Patent [19]

Torffield

[11] 4,190,739

[45] Feb. 26, 1980

[54] HIGH-FIDELITY STEREO SOUND SYSTEM

[76] Inventor: Marvin Torffield, 50 Greene St., New York, N.Y. 10013

[21] Appl. No.: 945,895

[22] Filed: Sep. 26, 1978

Related U.S. Application Data

[63] Continuation-in-part of Ser. No. 791,473, Apr. 27, 1977, abandoned.

[51] Int. Cl.[2] ..... H04R 5/02

[52] U.S. Cl. ..... 179/1 GA; 179/1 E; 179/1 AT; 181/155; 181/30

[58] Field of Search ..... 179/1 GA, 1 G, 1 E, 179/1 AT; 181/153, 154, 155, 176, 191, 30

[56] References Cited

U.S. PATENT DOCUMENTS

| | | | |
|---|---|---|---|
| 1,854,542 | 4/1932 | Cooke | 181/30 |
| 1,976,379 | 10/1934 | Weinberger | 181/30 |
| 2,337,839 | 12/1943 | Rider | 181/153 |
| 2,643,727 | 6/1953 | Leon | 181/155 |
| 2,710,662 | 6/1955 | Camras | 179/1 GA |
| 2,896,736 | 7/1959 | Karlson | 181/30 |
| 3,672,463 | 6/1972 | Jaffe et al. | 181/30 |
| 3,765,504 | 10/1973 | Itoh | 181/155 |

FOREIGN PATENT DOCUMENTS

| | | | |
|---|---|---|---|
| 1202188 | 1/1960 | France | 181/30 |
| 1333063 | 6/1963 | France | 181/30 |
| 898445 | 6/1962 | United Kingdom | 179/1 GA |

OTHER PUBLICATIONS

"Acoustic Problems" by Nixon in *Electronics* May, 1948, pp. 86–89, 181–30.

*Architectural Forum,* Feb. 1946, pp. 98–100, 181–30.

*Primary Examiner*—Douglas W. Olms

*Attorney, Agent, or Firm*—Brumbaugh, Graves, Donohue & Raymond

[57] ABSTRACT

Sound reproduction systems using sound reflectors and the reflectors for the same are disclosed. Passive reflectors for redirecting sound from speakers spaced therefrom are described in several configurations. Two horizontally spaced loudspeakers, direct sound to two reflective surfaces. The surfaces are contoured to redirect the sound to a listening area. The surfaces can be smooth and substantially larger than the speakers. Reflectors that are partly or entirely roughened across their reflective surface disperse sound, particularly high frequencies, and give a large, stable acoustic image.

11 Claims, 8 Drawing Figures

FIG. 6
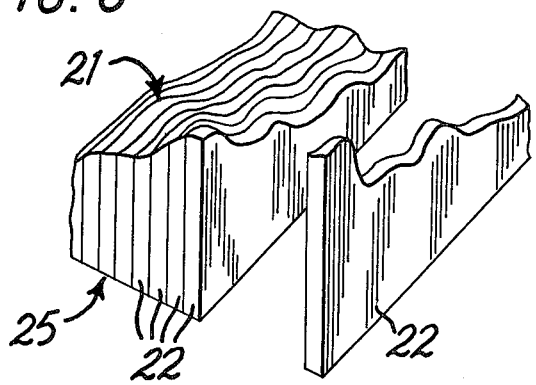
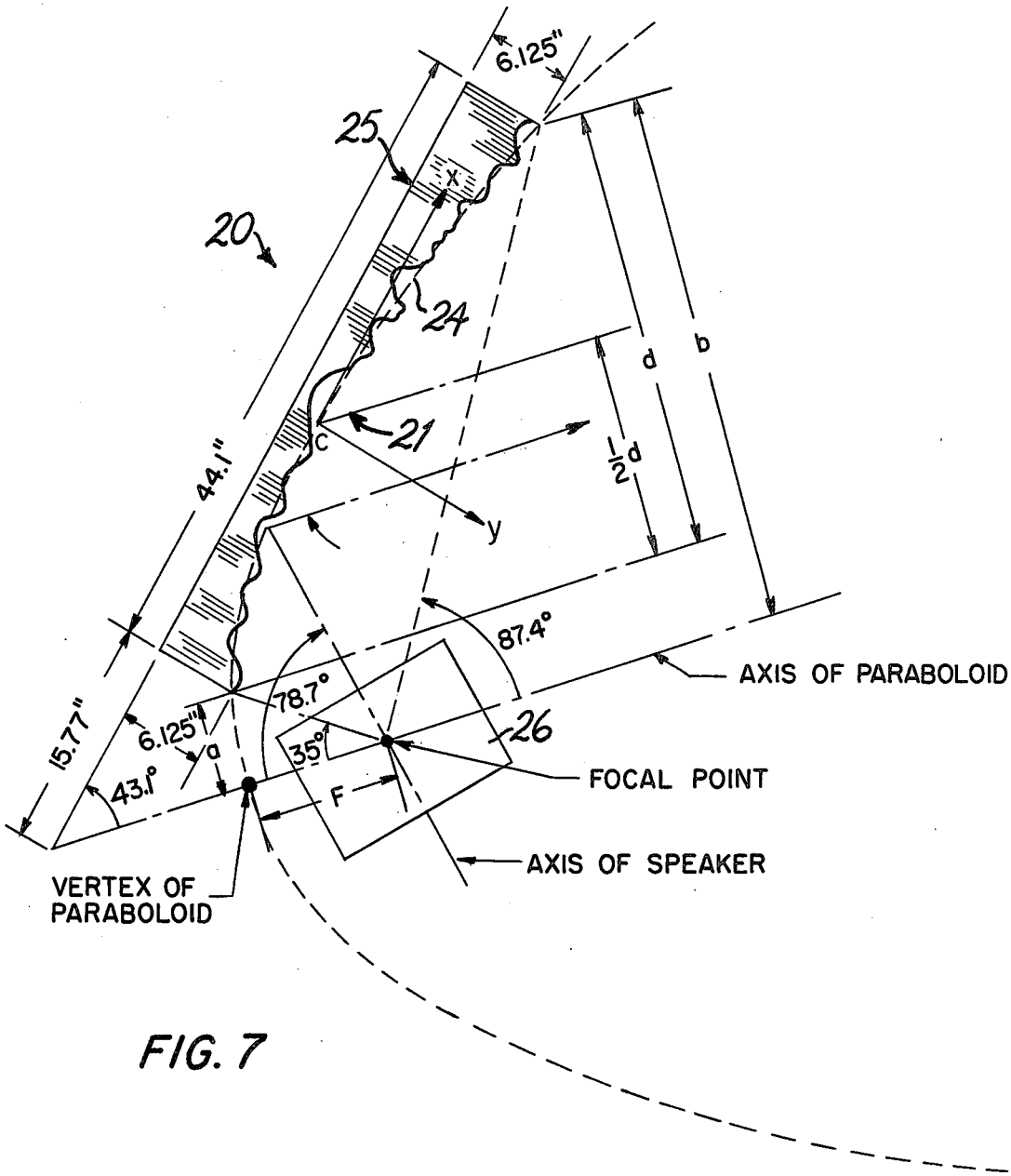
FIG. 7

HIGH-FIDELITY STEREO SOUND SYSTEM

This application is a continuation-in-part of my now abandoned previous application Ser. No. 791,473, filed Apr. 27, 1977.

BACKGROUND OF THE INVENTION

This invention relates to sound reproduction and more particularly to sound reflective and sound reproduction systems employing reflective surfaces.

Sound reproduction systems using passive, reflective surfaces in addition to active sound sources such as speakers are not unknown. By "speaker" or "loudspeaker" is meant one sound source or a system of several, each contributing a part of the audible frequency range. In the past, individual speaker enclosures have employed reflective elements internally to direct sound in one direction or another. Speakers have been suggested to direct sound against nearby walls for reflection back to a listening area. Sounding boards are known for use by instrumentalists to project sound either to an audience's listening area or to studio microphones. Various architectural acoustic elements have been employed or suggested to enhance the acoustical characteristics of auditoriums. Also, in connection with projection screens for motion pictures or television, sound reflecting surfaces have been suggested to associate more closely the sound track or audio portion of the program with the visual presentation. In high-fidelity sound reproduction systems, the use of nonarchitectural sound reflectors spaced from a speaker to redirect sound back towards the listener has been virtually unexplored.

The loudspeaker industry has for a long time made attempts to provide the listener with the kind of sound experienced under real-life conditions. The familiar stereo loudspeaker systems have been commercially successful because they went a long way towards realistic sound when compared with the original monaural loudspeakers. However, insofar as is known, the prior art has not provided a system of any kind which gives the listener the feeling of acoustical space and depth and scale which in an almost unexplainable way characterizes live sound.

Such attempts have included stereo loudspeaker systems wherein two speakers were pointed towards convexly curved surfaces for the purpose of distributing the sound and eliminating the well-known effect of the sound coming from more or less point sources. An example is the Ranger U.S. Pat. No. 3,065,816. Particularly for the reproduction of low-frequency sound components, reflective arrangements have been proposed, but it is generally conceded that the result has been an undesirably blurred sound reproduction.

One interesting example of the use of reflection for the purpose of achieving more realistic sound, is provided by the Karlson U.S. Pat. No. 2,896,736, July 28, 1959, proposing the use of a loudspeaker in an especially designed enclosure and pointed towards a wall for the purpose of obtaining considerably greater angular dispersions of sound than the typical 90° to 120° sound dispersion which the patent states is characteristic of conventional conical loudspeakers radiating directly into an air space. This patent makes various proposals one of which is to reflect the sound from the specially enclosed loudspeaker via differently curved surfaces, such as elliptical, hyperbolic, etc. This patent states that such curved surfaces permit projection of sound over considerable distances with minimal losses.

Little attention has been given to the effects of the surface of a reflector. In acoustics, whereven roughness or surface irregularities have been provided, they have been associated with sound absorption, not with sound reflection. The dispersive effect of surface roughness or irregularity has been largely or wholly ignored relative to sound reproduction systems.

In the reproduction of sound a recurrent phenomenon has been differences in the angle of dispersion of the sound for various frequencies in the audible range. Ordinarily the base frequencies are more widely dispersed and the higher audible frequencies are more narrowly dispersed. This characteristic is called herein "beaming" by virtue of the narrower or beam-like projection or cone of the higher frequencies. Again, as far as is known, there has been no attempt to resolve this recurrent difficulty by attention to the surface characteristics of a reflector.

BRIEF SUMMARY OF THE INVENTION

In accordance with this invention, sound reflectors and sound reproduction systems using these reflectors are employed to modify the sound characteristics, the acoustic image and/or the subjective impression that the reproduced sound produces in the listener as compared to conventional high-fidelity stereo systems or the like.

In one stereo system according to the present invention, two horizontally interspaced loudspeakers are used which need not be specially designed providing they are capable of good point-source sound radiation free from objectional distortion throughout the frequency range of sound typically desired by the high-fidelity listening public. Incidentally, by point-source sound it is intended to mean the sound source of relatively restricted areas provided by even the largest loudspeakers currently available. Each loudspeaker is provided with a reflective surface which is spaced from the loudspeaker. In certain embodiments the surface is of very substantially larger surface area than the radiation area source provided by the loudspeaker.

Assuming the loudspeaker to radiate directly into air with a maximum sound dispersion angle of about 90° to 120° as referred to by the aforementioned Karlson patent, and with consideration for the spacing of the loudspeaker from its reflective surface, the reflective surface of this embodiment has a surface area large enough to receive substantially all of the sound beam from the loudspeaker, excepting possibly for the lowest frequencies of sound.

Furthermore, in several arrangements, the reflective surface can have a curvature, possibly a concavity both vertically and horizontally, formulated to focus the sound reflected from its loudspeaker either to a point, in the event listening is to be done from a single position, or throughout a restricted listening area, so that listening by a group of persons is accommodated. In certain smooth-surfaced and concave reflectors of this kind the sound image 5 is not stable in the manner ordinarily desired of stereo reproduction. Rather the image or apparant source of the sound seems to the listener to move if the listener moves. This characteristic is ordinarily undesirable in usual sound reproduction equipment but can be considered a novel and attention-getting "special effect" useful outside the ordinary stereo-high-fidelity context. When large reflective surfaces are used, the reflective surface may focus the sound to an area of smaller size than that of the surface, but which may be larger than the loudspeaker sound radiator area.

The orientations of the loudspeakers and the reflective surfaces are such that the two listening points or zones coincide or merge to form a common listening area. The two reflective surfaces may be interconnected horizontally side-by-side or interspaced and angularly oriented relative to each other. In addition, the formulation of the two reflective surfaces is preferably such that all sound frequencies within the normal listening range of frequencies are reflected to the listening point or area where the sound is focused, without appreciable phase shifting to a degree where the sounds reflected from the two reflective surfaces are out of phase enough to cancel each other to an objectionable degree.

In the case of one prototype of the present invention, the two reflective surfaces, horizontally positioned side-by-side and interconnected, form a reflective wall 40 feet long by 7½ feet high. Two conventional loudspeakers of good quality were positioned 12 feet from their reflective surfaces and about 20 feet apart from each other, pointed to project their flaring beams of sound with axes parallel to each other and aimed centrally into the reflective surface in each instance. The curvatures of the reflective surfaces were formulated to reflect the sound from each loudspeaker to a point centrally between the loudspeakers.

This prototype has been demonstrated to the most prominent persons of skill in the art of sound reproduction and they have all agreed that comparable sound has never been reproduced before. The effect is one of sound existing in space. With the speakers powered by a good source of stereo signals, the real-life positions of sound sources could be aurally fixed by a listener of this system, one behind the other. There was no feeling or sensation that the sound emanated from localized sources or that it was projected as a flat plane free from depth. The actual source of the sound, namely the two loudspeakers, could not be aurally detected.

Although the single restricted area toward which the two reflective surfaces were focused provided the maximum intensity of sound and the greater feeling of depth, listening at other locations also produced the effect of the listener being surrounded by and within the sound. In addition to the feeling of sound depth, the stereo effect was extremely realistic. In other words, in the case of the reproduction of sound which in real life has involved not only depth or different distances from the listener, but also motion, the effect obtained was one of real sound sources passing the listener.

For home use the two reflective surfaces of the embodiment just described are reduced in size, although remaining substantially larger than the loudspeaker sound radiating sources and of the listening area into which the surfaces focus the reflected sound. For example, reflective surfaces in the order of from 5 to 8 feet square can be used with the loudspeakers angularly related to each other and to their reflective surfaces, the loudspeakers, for example, being suspended from the ceiling of the listening room. The positioning or sound travel directions of the loudspeakers and of the reflective surfaces should be arranged so that the two surfaces reflect to a common listening area or zone having a cross-sectional area of focus large enough to accommodate a group of listeners comfortably seated and arranged. The spacing of the loudspeakers relative to their reflected surfaces should be such that the loudspeaker flaring sound beams are substantially completely encompassed by the reflective surfaces, the latter being possibly concave in all directions with their curvatures formulated to focus the reflected sound from the two surfaces to the common listening area.

The actual formulation of the curvatures of the reflectors is within the skill of persons knowledgeable in the art of geometrical optics. In the case of the prototype specifically referred to above, the formulation for that example is described by the "IEEE Transactions on Antennas and Propagation", May 1976, Copyright 1976 by The Institute of Electrical and Electronics Engineers, Inc.

The large reflective surfaces used by the present invention are in themselves art objects. The previously referred to prototype was made with its surfaces formed by Sitka spruce with their backs braced by ribs made of plywood so that the surfaces did not inherently reverberate materially when reflecting the sound, the reflecting surfaces being smooth. A photograph of that prototype appears in the May 1976 issue of "Artforum", published by California Artforum, Inc., New York, New York.

A second prototype smooth reflector has been built and demonstrated, this one being 40 feet long and 7½ feet high, the two speakers being arranged substantially the same as in the case of the first prototype previously referred to. In this case the reflective skins were birch plywood with suitable back bracing.

Ordinarily, a loudspeaker produces the aforementioned beaming effect in the high frequencies whereby the higher frequencies in the audible range are not as widely dispersed from the speaker as are the lower audible frequencies. The above-mentioned reflectors having smooth reflective surfaces do not, of themselves, eliminate beaming. Rather, the high frequencies may be directed to a smaller portion of the reflective surface and then reflected to the listening area. Roughening of some or all of the reflecting surfaces helps to spread the higher, reflected frequencies throughout the listening area by dispersing sound impingent on the roughened surface.

A random or irregular roughening over the whole surface assures dispersion of all frequencies throughout the upper audible frequency range from for example 1,000 to 20,000 Hz and gives dispersion from the entire roughened surface. All portions of the direct sound throughout the listening area. The surface is a uniformly radiating reflector.

The roughening of two spaced reflectors substantially reduces sensitivity of the stereo system to listener position. A listener moving from one position to another in the listening area continues to hear a good stereo effect, rather than hearing sound predominantly from one speaker as he moves to the side of the listening area. This can be called a stable image; one that does not vary in position as the listener's position changes. A corollary of this is that the improved stereo effect is not especially sensitive to the positioning or spacing of the reflectors within the room.

The roughened reflective surfaces also reduce the point or "window" effect characteristic of loudspeakers. Subjectively, the audible "image" is not identified with the location of the speaker or reflector, but is located in space at a distance from the listener. The listener is not engulfed in sound as in the case of the above-mentioned smooth surfaced prototypes. The apparent source is solidly established in space between the two roughened reflectors. The acoustic image sounds large or "panoramic". This latter is the most striking or distinguishing feature of the sound thus produced.

Like the aforementioned smooth reflecting surfaces, roughened reflectors can have an overall concavity. Onto this concavity the roughness is imposed. In a particular embodiment, a paraboloid is the underlying concavity and about the paraboloid a series of curves fluctuate. The curves are additions of sinusoids that vary with their position on the surface. Two such reflectors concentrate the reflected sound from speakers at their focal points into a listening area. Yet through the listening area the sound is dispersed by the roughened surfaces. Unlike the speakers, referred to above, that employ reflectors within their enclosure or direct sound against nearby walls, no characteristic distortion of the reproduced sound has been noticed when the roughened surfaces have been tested.

In the tests of reflectors so-formed, the sounds appear to be distributed throughout the room without "beaming" in any frequency. Efficiency appears high inasmuch as lower volume levels are needed to produce good reproduction than with the speakers simply directed into the listening space without reflection.

Finally, in testing the roughened reflectors the quality of the sound produced can be described, albeit again subjectively, as "airy". The overall sound was surprisingly pleasing, for when the speakers themselves were redirected into the listening area, the character of the sound was dramatically less satisfactory, and the above effects, ascribed to the reflectors, diminished or disappeared.

As in the case of the smooth reflective surfaces the roughened surfaces can be visual art. The surface roughness can be formed in innumerous configurations and using any of a wealth of available materials provided the roughness is sufficiently varied to disperse many or all frequencies, particularly high frequencies, and provided the material is "hard" and reflective, not "soft" and absorbent. The choices available permit sufficient freedom of expression for surface formulation to be art. In an actual embodiment of a surface, marble gravel was glued across the surface of a parabolic surface like the parabolic surface of well-known microwave antennas. In another embodiment, chosen to be expressive of the rich complexity of sounds, a series of curves that are additions of varying sinusoids were added to an underlying paraboloid to form an undulant topography of hills and valleys. The variations in height and spacing of these hills and valleys are adquately random to insure dispersion of sound throughout the listening area, and yet this surface configuration was chosen on the basis of visual aesthetics as well as acoustics.

BRIEF DESCRIPTION OF THE DRAWINGS

The foregoing and further features of the invention will be better understood with reference to the following detailed description of a preferred embodiment and the attached drawings wherein:

FIG. 6 is an enlarged, fragmentary perspective view of a reflector like that of FIG. 5 and illustrates its laminar construction.

FIG. 7 is a diagramatic illustration of a reflector like that of FIG. 5, a speaker, and their spatial and acoustic relationship.

DETAILED DESCRIPTION OF THE INVENTION

Figure 1:
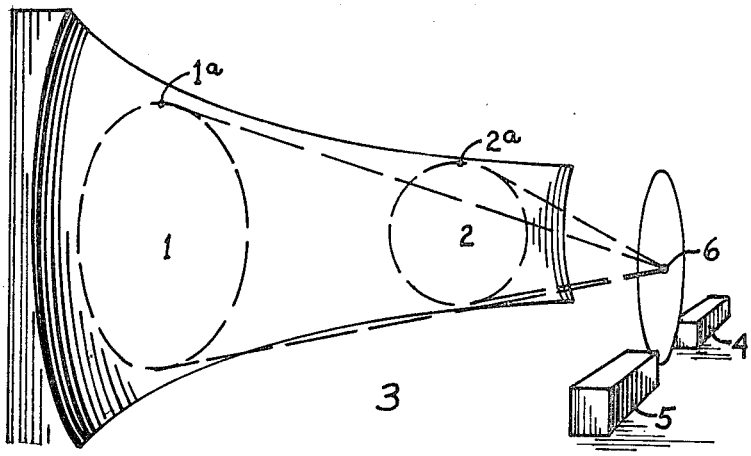
FIG. 1 is a perspective view of the aforementioned prototype.

The second prototype, previously referred to, comprises the two reflective surfaces 1 and 2 positioned side-by-side and interconnected, the two surfaces being concave both vertically and horizontally with curvatures as described by the foregoing IEEE Transactions publication. The effect is that of a single long decorative wall supported on the floor 3 of a large room or gallery with the two loudspeakers 4 and 5 positioned as previously described. The two reflective surfaces individually reflect the sound from the two loudspeakers to the common point indicated at 6. The effects obtained have been summarized rather completely above.

In more detail, the surface 1 receives the sound cone from the speaker 5 throughout an area generally indicated by the broken line outline 1*a*, from the speaker 5, while the corresponding area of the surface 2, with respect to the speaker 4, is in the same way outlined as at 2. It is to be understood that, depending on the characteristics of the speakers 4 and 5, assuming they are of commercially available kinds, these sound receiving areas may vary. However, the sound is reflected to a focus at the listening point 6 at an elevated position where the listener's ears would be expected to be. In the case of this second prototype, with the speakers 4 and 5 supported by the floor 3, the speakers 4 and 5 have the characteristic of projecting vertically elongated sound patterns, so that at the point 6, what was essentially a vertical focal area of listening position was obtained. This was because the second prototype was demonstrated in a gallery occupied by persons of different heights in standing positions. Although the focused area 6 provided the most effective sound, the same effect persisted to a substantial degree in the case of persons walking to and from the reflective surfaces and in front of and behind the two loudspeakers. The gallery in which this prototype was demonstrated was approximately 40 by 70 feet and had about a 15 foot high ceiling.

Figure 2:
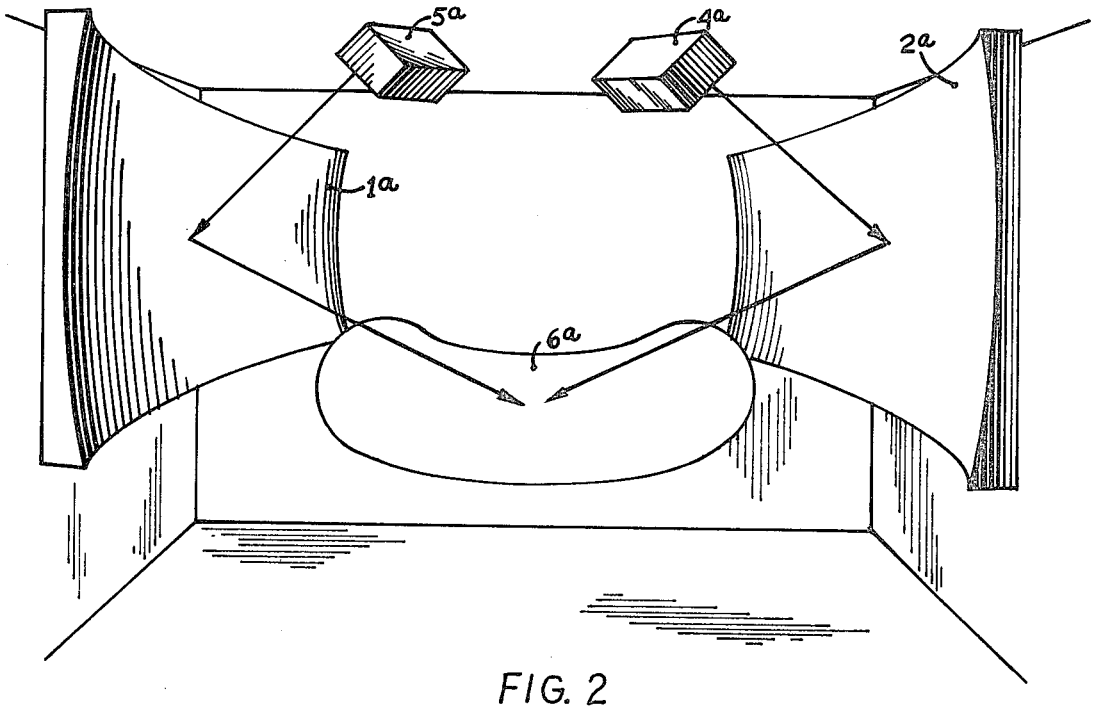
FIG. 2 is a perspective view showing the embodiment of the invention wherein the reflective surfaces are separated from each other and are of smaller dimensions than the prototype of FIG. 1.

In FIG. 2 of the two surfaces 1*a* and 2*a* are shown with similar dimensions, such as in the area of 7 by 7 feet, positioned approximately opposite to each other and supported by the walls of a room, the two loudspeakers 5*a* and 4*a* being suspended from or fixed to the ceiling and pointed downwardly towards their reflectors which in this case have their curvatures formulated to focus the reflected sound downwardly into a relatively large area indicated at 6*a*.

Figure 3:
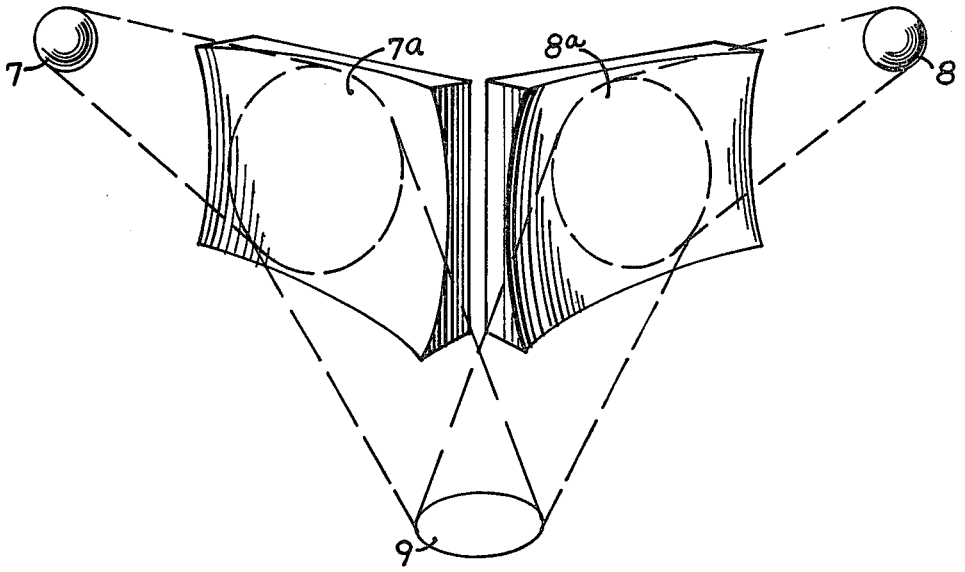
FIG. 3 in perspective schematically illustrates the principles of the present invention.

FIG. 3 illustrates the principle of the present invention. Schematically shown are two loudspeaker direct sound radiating cones 7 and 8 with their projected sound impinging on the reflective surface areas indicated at *7a* and *8a* from which the reflected sound is focused at the listening location 9.

Figure 4:
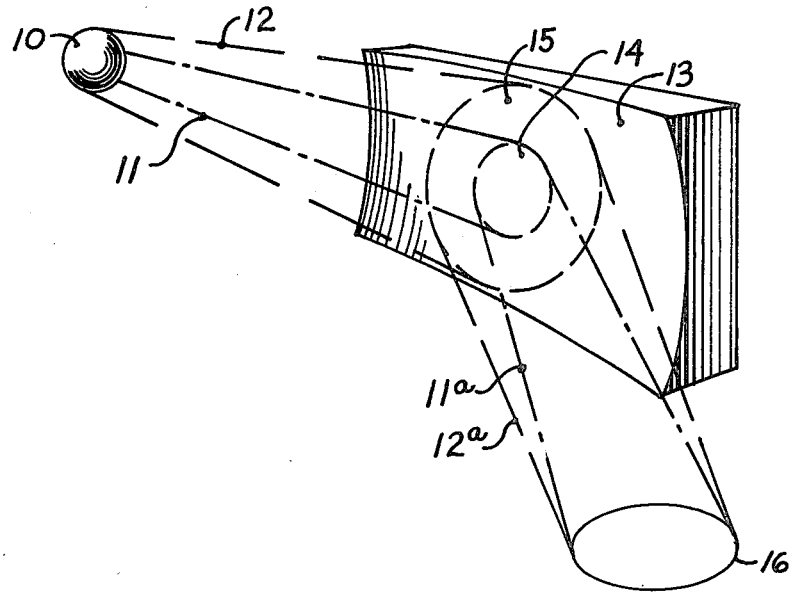
FIG. 4 is a schematic perspective representation of a possible modification.

Some loudspeakers tend to beam the high frequencies of their reproduced sound with a narrow projection cone while beaming the lower frequencies throughout a more widely spreading cone of sound. Such an instance is represented by FIG. 4 where only one loudspeaker and one reflective surface is illustrated, with the understanding that the other assembly would be the same. Here the loudspeaker 10 is projecting a narrow high-frequency sound cone indicated at 12. This means that the sound cone 11 is concentrated on the reflective surface 13 of the kind previously described, over a restricted area 14 while the low frequencies strike the surface over the substantially larger area 15. To compensate for this, the area 14 of the reflective surface 13 is made with a prismatic or other surface of the type known to disperse or spread or diffuse reflected sound, the result being that the reflected high-frequency sound flares, as indicated at 11*a*, while the low frequencies are reflected as shown at 12*a*, so that all of the sound frequencies focus at the listening area 16.

Figure 5:
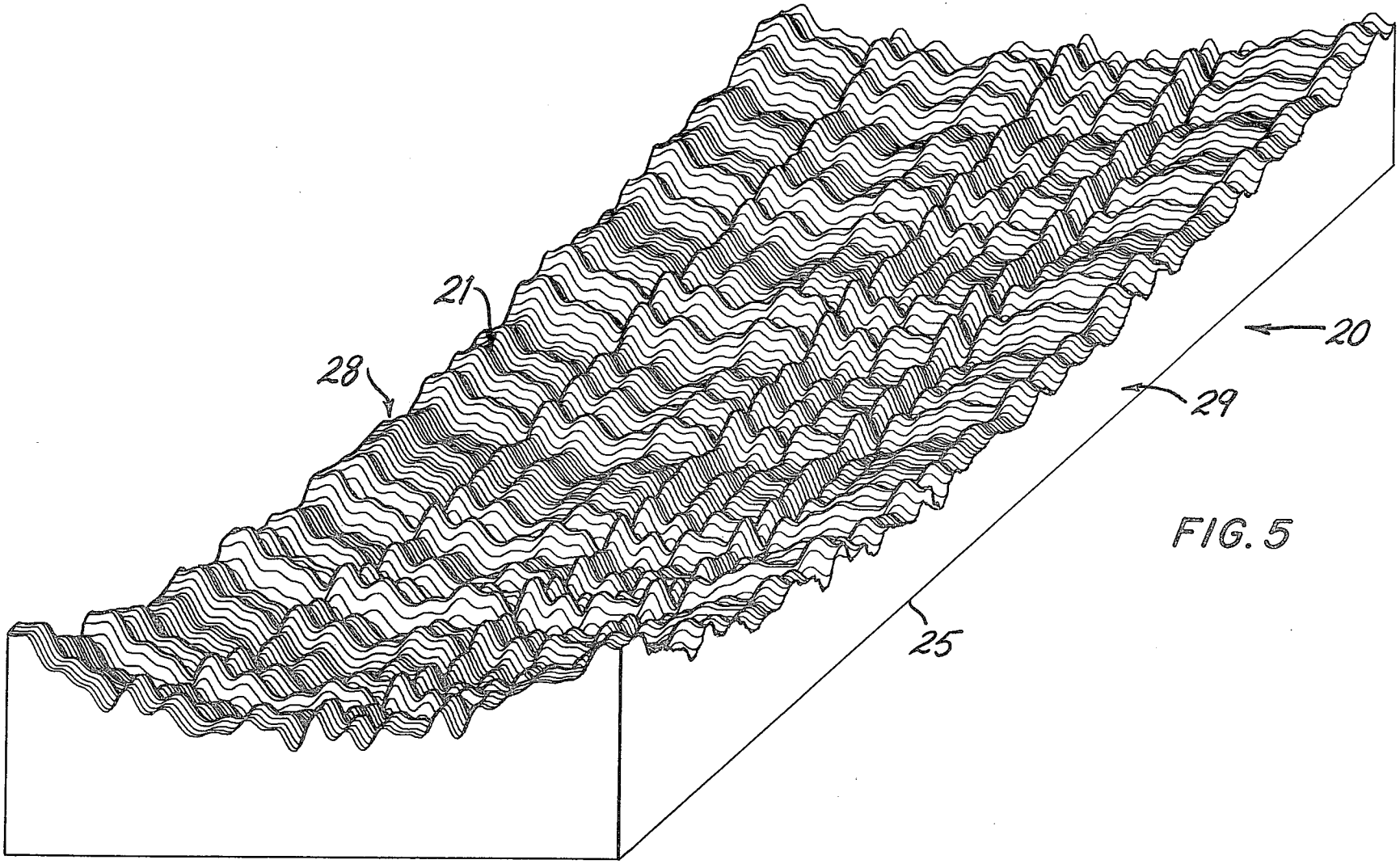
FIG. 5 is a perspective view of a reflector according to a further embodiment of the invention and shows one form of a roughened reflecting surface.

In FIG. 5, a further embodiment of the invention is seen. A reflector 20 is formed with a generally concave and substantially randomly roughened reflective surface 21.

Two reflectors essentially as depicted in FIG. 5 have been formed and tested. FIG. 6 indicates the manner of fabrication of the two prototype reflectors formed in accordance with FIG. 5. One eighth inch masonite sheets 22 were cut, two at a time, and one of each pair assembled side-by-side to form the undulant peaks and valleys that roughen the surface of the reflectors. Of course, other techniques for forming the roughened surface may be used, depending on the materials, the number of reflectors to be made, and the exact configuration of the roughened surface desired.

In the embodiment of FIGS. 5 and 6, the roughened surface comprises an underlying or base curvature or concavity about which fluctuates the series of peaks and valleys. The underlying curvature is, in this case, a segment from a paraboloid as illustrated in FIG. 7 where a parabola 23 is indicated in broken lines and an asymmetrical segment 24 thereof is illustrative of one of the family of parabolas forming the paraboloid underlying the reflective surface 21. The focal length F of the paraboloid is 10 inches (25.4 cm.). The dimension a, measured perpendicular from the axis of the paraboloid to the nearest edge of the paraboloid section that is the underlying curve, is 6.305 inches (16.01 cm.). The dimension b, measured perpendicular from the axis of the paraboloid to the farthest point on the paraboloid section is 36.4 inches (92.46 cm.). The width of the reflector is 25 inches (63.5 cm.), and its length is 44.1 inches (112.01 cm.).

The exact surface configuration can be varied from one reflector to another. In the prototype embodiments that were constructed, as shown in FIG. 5, the surfaces were chosen as much for visual aesthetics as for acoustics. Certain considerations apply, however. The height and depth of undulations or peaks and valleys should not be so severe as to cause the surface to absorb high-frequencies as would an anechoic surface. In the prototypes the curvature imposed on the parabola has an RMS roughness or amplitude of 0.5 inches (12.7 mm.). This is the RMS amplitude of the curvature forming the peaks and valleys before they are added to the paraboloid. The frequency of peaks and valleys across the short (y) dimension or the long (x) dimension should be such that dispersion occurs in all directions from all areas of the surface, and without notable "dead" spots. The roughness should preferably have a substantial randomness so that all audible frequencies, at least in the higher audible range, will be dispersed and in substantially all directions from all sections of the surface within a wide angle of dispersion. In this way the listener will hear all audible frequencies, at all locations in the listening area, and from all portions of each reflector's surface.

The surface of FIG. 5 was chosen from a number of surfaces. Representations of the various surfaces were generated by digital computer and plotted with small step sizes to give nearly continuous curves. The equations defining the surfaces were varied until a representation appeared to have the visual and functional characteristics desired. In each direction x and y the curves imposed on the paraboloid are additions of many sinusoids, each of the added sinusoids differing in its angular expression so that a complex or substantially random surface results capable of spreading essentially all of the higher audible frequencies in all directions fairly evenly. A simple, regular surface, it was believed, could result in reflection of one or more frequencies strongly in some directions but weakly in others. In the exact surface chosen, the sinusoid of highest frequency in both the x and y direction was given a peak to peak spacing of 1.2 inches (30.48 cm.) for wide angle dispersion of the highest audible frequencies.

The roughening of the surface need not be by curves that are sinusoids, or any regular mathematical function. Other examples are mentioned below. Sinusoids were chosen for the prototype to give a visual impression of sound, conceptually tying together the functional and aesthetic character of the surface.

The surface of FIG. 5, which is the surface chosen in the above manner, is characterized by the following equation:

$$z = 0.9366370694x + 54.92313982 - 1.370141963\sqrt{u} + G(x) + H(y);$$

where $z$ = height $$u = 1606.865692 - y^2 + 54.80567853x;$$

$$G(x) = 0.07 \sum_{n=1}^{n=50} \sin\left[\frac{n\pi x}{30} + P(n)\right]$$

$$H(y) = 0.07 \sum_{n=1}^{n=50} \sin\left[\frac{n\pi y}{30} + P(n)\right].$$

In the foregoing, x is surface height perpendicular to the base surface 25, the x axis is parallel the base surface in the longitudinal direction, and the y axis is parallel the base in the transverse direction. The z axis is across the paraboloid, parallel the base, which is to say perpendicular the plane of the paper in FIG. 7. These coordinates are centered on the paraboloid at point c in FIG. 7, which is equidistant between longitudinal edges 28 and 29 and located at the point half the distance d from the bottom edge to the top edge of the paraboloid measured perpendicular to the axis of the paraboloid. The x axis is tangent the paraboloid. The surface equation is the formula for a paraboloid of the dimensions shown translated to the x, y and z coordinates centered at c and to which has been added the sums of fifty sinusoids in each of the x and y directions and each differing in its angular value by the value of n in $$\frac{n\pi x}{30} \text{ or } \frac{n\pi y}{30}$$

and by P(n). For the exact surface chosen, as shown in FIG. 5, to give the surface its desired random character, the following values of P(n) were selected for n32 1 to n=50 with the assistance of a random number generator:

| n | P (n) | n | P (n) | n | P (n) |
|---|---|---|---|---|---|
| 1 | .4748877480 | 18 | 2.852383811 | 35 | 1.126929905 |
| 2 | 3.539921719 | 19 | 4.961183096 | 36 | 5.270253786 |
| 3 | 5.127515406 | 20 | .3199394848 | 37 | 2.637792714 |
| 4 | 1.975335412 | 21 | 5.175323840 | 38 | .4192592288 |
| 5 | 2.496160021 | 22 | 4.483116566 | 39 | .7386342246 |
| 6 | .6866848399 | 23 | .3898473620 | 40 | 5.439222817 |
| 7 | 5.732087364 | 24 | 1.135995446 | 41 | .2274857784 |
| 8 | 1.482342382 | 25 | .3280032685 | 42 | 2.819980389 |
| 9 | 2.579252764 | 26 | 5.673780631 | 43 | 2.842646121 |
| 10 | 1.452643375 | 27 | 2.711862807 | 44 | 3.054970973 |
| 11 | 2.735128477 | 28 | 6.163539359 | 45 | 5.690983274 |
| 12 | .5972265156 | 29 | 6.191907573 | 46 | 4.612914598 |
| 13 | 5.895860370 | 30 | 4.916834872 | 47 | 2.735842199 |
| 14 | .9853639715 | 31 | .7221955529 | 48 | 1.197466856 |
| 15 | 5.593824766 | 32 | 4.180670473 | 49 | 1.759976430 |
| 16 | 4.584018661 | 33 | 3.643280939 | 50 | 3.591630128 |
| 17 | 3.567100803 | 34 | 4.088025319 | | |

To produce the prototypes of this surface, individual curves in the y or longitudinal direction were each computer generated, full scale. These then were used as templates and the ⅛" masonite segments 22, were cut corresponding to the traces. The segments 22 were clamped together as laminations to form the surface.

It is to be stressed, however, that the method of producing the prototypes, as just described, is not, by any means essential, to producing a functional roughened reflector. A programmed machine tool would be capable of producing a suitably roughened surface. A reflector approximating the texture of surface 21 can be fabricated for example, in ceramic, by hand manipulation of the surface prior to firing. Adherent stones or gravel, mentioned above, can give the desired sound dispersive effect. Cast concrete or various plastics are other possibilities.

In the prototype testing a pair of Tanoi Eaton speakers 26, which are 10 inch coaxial speakers in a suitable ported enclosure, were used. The sound source was located at or very near the focal point of the underlying paraboloid of each reflector as shown in FIG. 7. The sound emergent from the reflective surface, then, has a substantially planar wave-front. The reflectors were inclined essentially as shown in FIG. 7. The speakers were tilted as shown to direct sound to the entire reflector surface. The paraboloid curvature concentrates the reflected sound to the listening area between the two reflectors. The surface irregularities disburse the sound evenly throughout the listening area.

Figure 8:
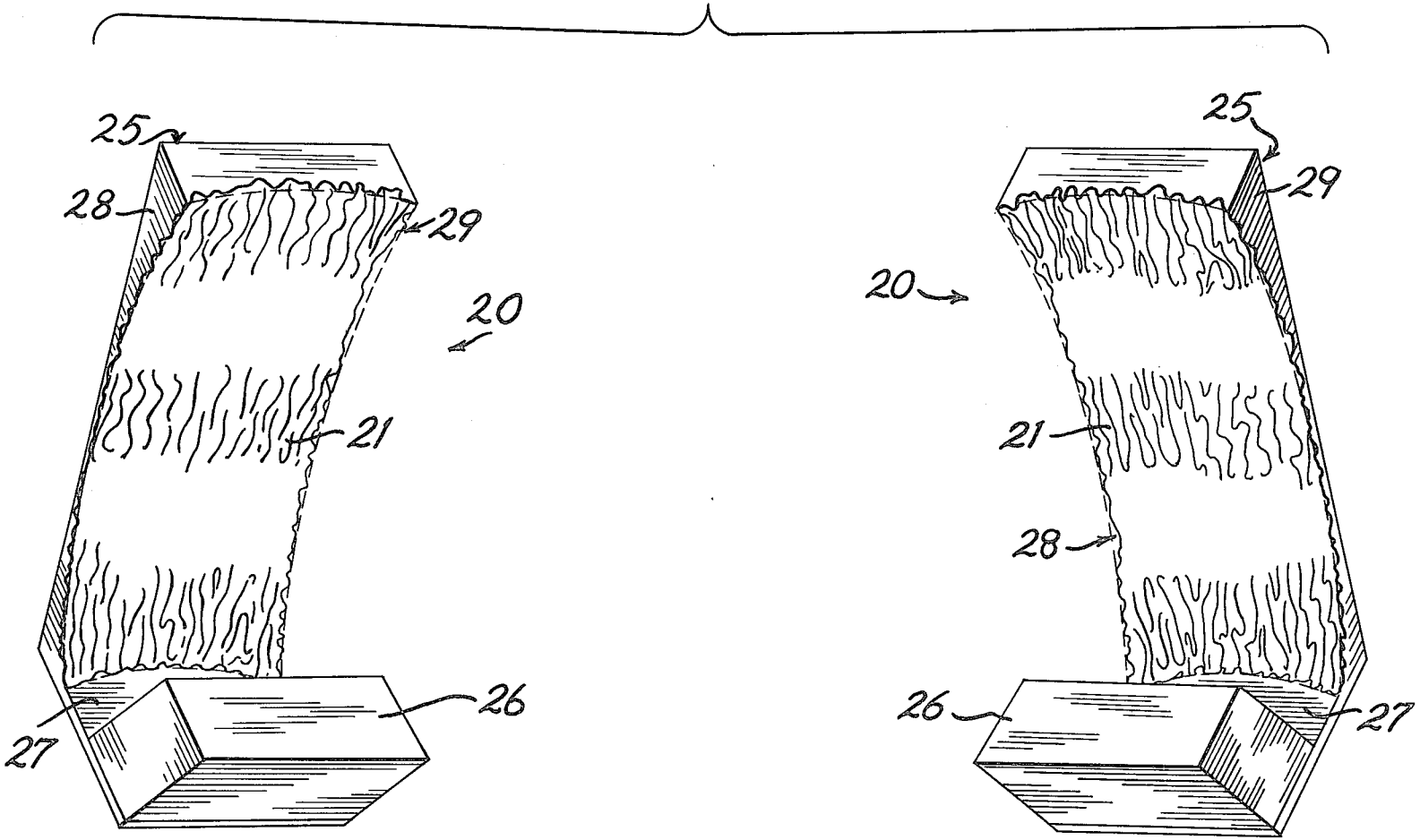
FIG. 8 is a perspective view further illustrating the relationship of a roughened reflector and associated speakers arranged for stereophonic sound reproduction.

FIG. 8 illustrates the relative relationship of a pair of speaker enclosures 26 supported on bases 27 to direct sound to the roughened surfaces 21 of the reflector 20. The sound reflected from the surfaces 21 to a wide listening area is stereophonic and has the remarkably improved characteristics described above.

The roughened reflector surfaces can take on other shapes and sizes. For example, the reflectors of FIGS. 1 through 4 could be modified so as to have the relatively random roughness depicted in FIG. 5. The underlying curvature of the reflector depends largely on its intended relative location with respect to the speaker and the listening area. Because the roughened surface reflectors can be made from a wide variety of materials and in a large number of configurations, the embodiment illustrated in FIGS. 5–8 are illustrative only. None of the embodiments illustrated and described should be construed as limiting the scope of the current invention, that scope being set forth in the appended claims.

What is claimed is:

1. A high-fidelity stereo sound system comprising at least two horizontally interspaced loudspeakers and an individual sound reflective surface for each of said speakers, each loudspeaker being spaced from and arranged to project sound towards its reflective surface, each of said surfaces being positioned and shaped with a curvature so as to reflect sound from its speaker to a listening area spaced from that surface and common to that of the other speaker, said surfaces having a surface area substantially larger than said loudspeakers, said loudspeakers producing both low and high-frequency sound with the high-frequency sound forming a sound beam of narrower angularity than the low-frequency sound, and said reflective surfaces having central roughness forming reflective sound dispersive surfaces and surrounding smooth surfaces.

2. A sound reflector for use with a sound source spaced therefrom and directing sound thereto, the reflector having a sound dispersive surface forming an expanse larger than the sound source in area, and continuously roughened across its surface by peaks and valleys of varying height and depth occurring in all directions from any point within the roughened surface, said peaks and valleys that occur in all directions on the roughened surface defining a surface being adapted to disperse at least a portion of the audible frequency range impingent thereon widely through a listening area from substantially the entire roughened surface.

3. The reflector according to claim 2 wherein the roughened surface is at least two feet wide and at least three feet long, the peaks and valleys extend across substantially the entire surface in all directions and vary irregularly in shape, and the peak to peak spacing in the direction of both the surface length and width is less than two inches.

4. The reflector according to claim 2 wherein the contours of said peaks and valleys are substantially nonplanar, vary in shape, and provide on said surface an irregular roughening reflective of sound of many frequencies in many directions from the surface.

5. The reflector according to claim 2 wherein the roughened surface has a shallow underlying concavity over which said peaks and valleys range, thereby concentrating sound in the listening area without interfering with the wide angle of dispersion from over the entire roughened dispersive surface.

6. The reflector according to claim 5 wherein the underlying concavity is a segment of a paraboloid with a focal point defining the sound source location.

7. A sound system including the reflector of claim 2 and further comprising a sound source, the sound source being located in spaced relation to the surface and aimed to direct the major portion of the sound produced thereby directly to the roughened dispersive surface for reflection directly back past the sound source from the surface towards the listening area.

8. A sound system including the reflector of claim 6 further including a speaker located at the focal point of the paraboloid from which the segment is taken and positioned to direct sound onto substantially the entire roughened surface, said speaker being substantially smaller in its sound emitting area than the area of the roughened dispersive surface, and whereby at least some of the reflected sound emerges in a substantially planar wave front.

9. A uniformly radiating sound reflector having a generally shallow concave sound reflective surface modulated by rounded irregular peaks and valleys across substantially the entire surface for dispersing sound widely from all of the surface thus modulated, the concavity of the surface being such that sound being reflected from the surface emerges in a generally planar wave front, the concavity being defined by a segment of a paraboloid having a vertex spaced from the segment and the uniform radiation provided by said modulations providing a relatively large apparent source of sound substantially positionally stable with respect to a listener moving in the listening area.

10. A sound system including a sound reflector having a shallow concave roughened sound reflective surface for concentrating and reflecting sound to a listening area, a speaker supporting means locating the speaker between the reflective surface and the listening area, said surface being larger than the sound emitting area of the speaker and having a multiplicity of peaks and valleys varying in height, depth, shape and spacing, said speaker being positioned to direct sound away from the listening area directly to the entire reflective surface, free of intermediate reflections, the curvature of said surface comprising an underlying paraboloid segment on which said peaks and valleys are imposed, the paraboloid segment being taken from a paraboloid with a vertex spaced from the segment, said means for locating the speaker retaining the speaker at said focal point, the concavity of said reflector being sufficiently shallow that a major portion of the sound directed to any portion thereof from the speaker is reflected back from the reflector past the speaker to the listening area free of further reflections, whereby sound is dispersed from all parts of the surface widely throughout the listening area without intermediate reflection so that in a large number of locations in the listening area the same sound is heard from all over the reflector to give an audible impression of an enlarged and stable sound source.

11. The sound system according to claim 10 wherein the peaks and valleys are defined by undulating curves along both the width and the length of the reflector defining a multitude of peaks and valleys for dispersing sound widely from all localities on the reflector.

* * * * *